US008376197B2

(12) United States Patent
Barbanti

(10) Patent No.: US 8,376,197 B2
(45) Date of Patent: Feb. 19, 2013

(54) UPGRADED IRONING MACHINE, PARTICULARLY FOR IRONING AND DRYING GARMENTS, SUCH AS SHIRTS, JACKETS OR THE LIKE

(75) Inventor: Carlo Barbanti, Frazione San Giacomo Roncole (IT)

(73) Assignee: Barbanti Carlo S.N.C., Mirandola (MO) (IT)

( * ) Notice: Subject to any disclaimer, the term of this patent is extended or adjusted under 35 U.S.C. 154(b) by 163 days.

(21) Appl. No.: 12/992,964

(22) PCT Filed: May 19, 2009

(86) PCT No.: PCT/IB2009/005644

§ 371 (c)(1), (2), (4) Date: Nov. 16, 2010

(87) PCT Pub. No.: WO2009/141704

PCT Pub. Date: Nov. 26, 2009

(65) Prior Publication Data

US 2011/0068135 A1 Mar. 24, 2011

(30) Foreign Application Priority Data

May 23, 2008 (IT) ..... MO2008A0151

(51) Int. Cl.
*D06F 73/00* (2006.01)
*A41H 5/00* (2006.01)

(52) U.S. Cl. ..... 223/70

(58) Field of Classification Search ..... 223/52, 223/66–77

See application file for complete search history.

(56) References Cited

U.S. PATENT DOCUMENTS

| | | | | | |
|---|---|---|---|---|---|
| 1,759,179 | A | * | 5/1930 | Wiesman | 34/105 |
| 1,763,193 | A | * | 6/1930 | Shields | 68/5 C |
| 2,284,232 | A | * | 5/1942 | Richa | 223/57 |
| 2,443,069 | A | * | 6/1948 | Gayring | 68/5 C |
| 3,568,900 | A | * | 3/1971 | Paris | 223/70 |
| 3,583,610 | A | * | 6/1971 | Forse | 223/57 |
| 4,274,214 | A | | 6/1981 | Haüser | |
| 5,732,859 | A | * | 3/1998 | LeBlanc | 223/67 |
| 2002/0095827 | A1 | | 7/2002 | Rosa | |
| 2007/0214689 | A1 | | 9/2007 | Jiang et al. | |

FOREIGN PATENT DOCUMENTS

| | | | |
|---|---|---|---|
| DE | 90 05 546 | | 7/1990 |
| FR | 2 716 211 | | 8/1995 |
| GB | 558522 | | 1/1942 |
| GB | 2 005 731 | | 4/1979 |
| GB | 2 020 317 | | 11/1979 |
| JP | 403162900 | A * | 7/1991 |
| WO | WO 2005/045121 | | 5/2005 |

* cited by examiner

*Primary Examiner* — Ismael Izaguirre
(74) *Attorney, Agent, or Firm* — Stein McEwen, LLP

(57) ABSTRACT

The upgraded ironing machine, particularly for ironing and drying garments, such as shirts, jackets or the like, comprises a bearing structure, a support element supported by the bearing structure and suitable for supporting a garment to be ironed, a steam or hot air supply circuit, emission means associated to the supply circuit and suitable for emitting a flow of steam or hot air for the ironing and/or drying of the garment, and suction means associated to the supply circuit for the suction and reuse during ironing and/or drying of at least a part of the flow of emitted steam or hot air.

15 Claims, 1 Drawing Sheet

Fig. 1
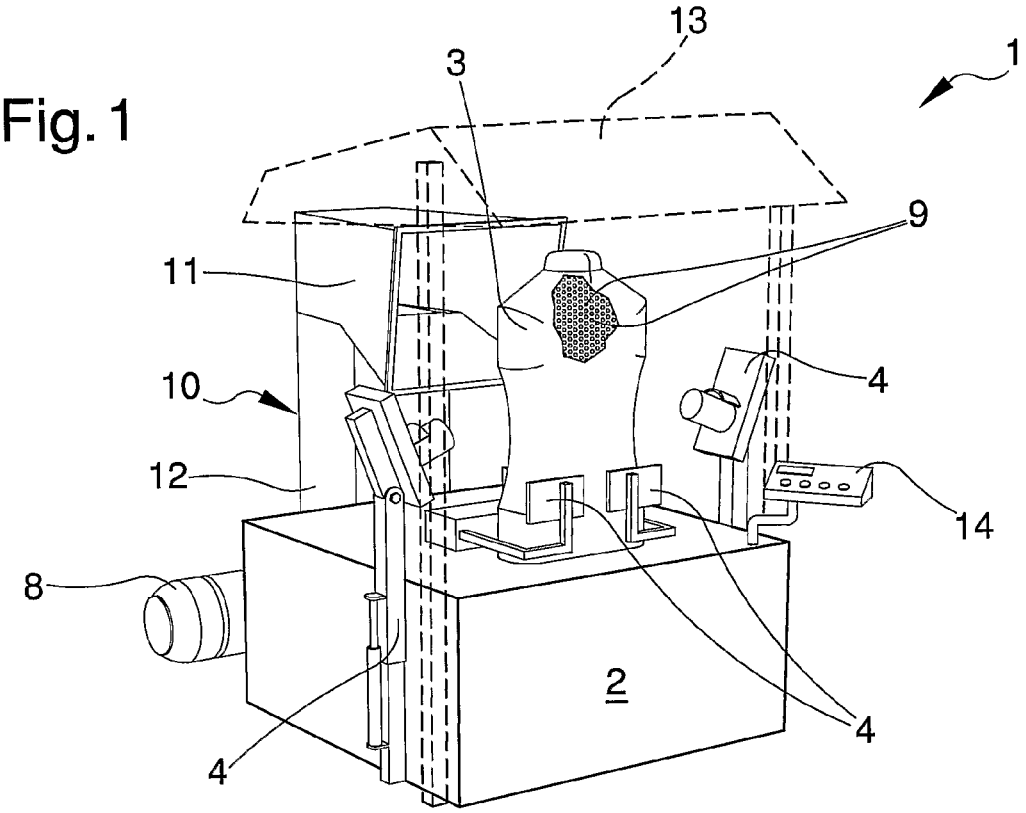
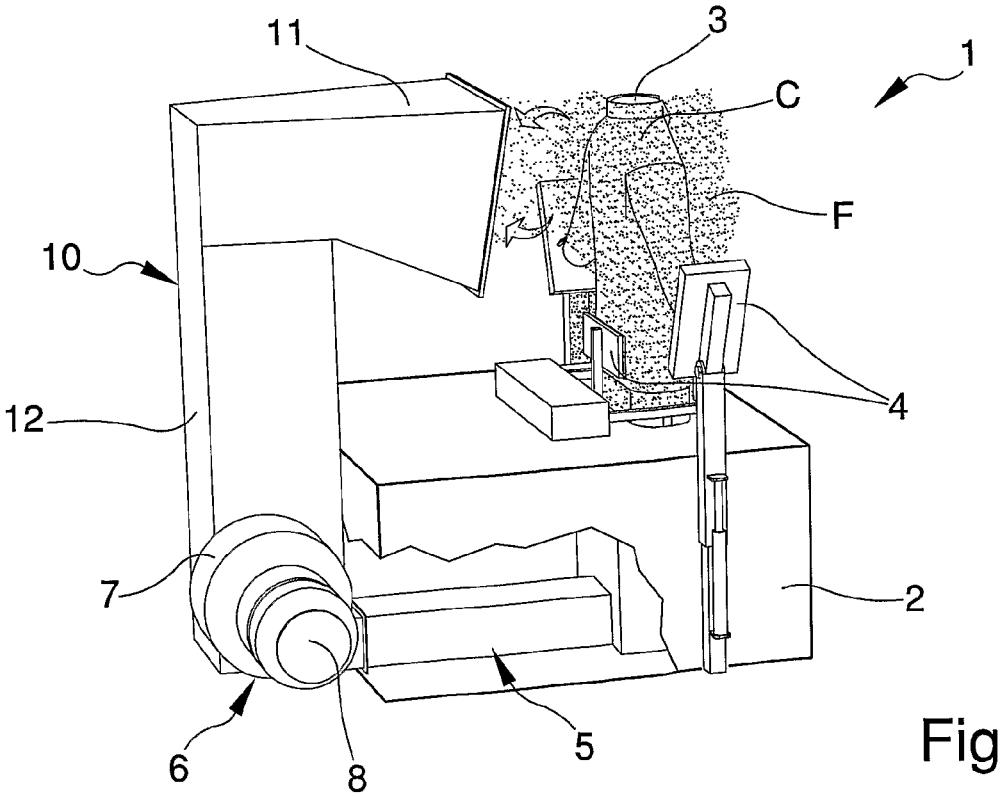
Fig. 2

UPGRADED IRONING MACHINE, PARTICULARLY FOR IRONING AND DRYING GARMENTS, SUCH AS SHIRTS, JACKETS OR THE LIKE

CROSS-REFERENCE TO RELATED APPLICATIONS

This application claims the benefit of PCT International Patent Application No. PCT/IB2009/005644 filed May 19, 2009, and Italian Patent Application No. MO2008A000151, filed May 23, 2008, in the Italian Patent Office, the disclosures of which are incorporated herein by reference.

BACKGROUND OF THE INVENTION

1. Field of the Invention

The present invention relates to an upgraded ironing machine, particularly for ironing and drying garments, such as shirts, jackets or the like.

2. Description of the Related Art

In the industrial laundry sector, and in the field of industrial ironing generally, the use of professional ironing machines for clothing is known.

With particular reference to the drying and ironing of shirts, work coats, jackets or the like, the use of special machines comprising a support structure for a mannequin of an appropriate shape to adapt to the specific garment and having, on the outer surface, a plurality of holes for the emission of hot air or steam, is known.

These machines are generally equipped with ventilation motor means associated to a steam generation means, of the external or internal boiler type, or associated to heating means for heating emitted air composed, e.g., of one or more electrical resistances.

Moreover, the known ironing machines generally have special tensioning elements, such as grippers, to grip the sleeves mounted on mobile arms, which are suitable for permitting the correct and complete stretching of the fabric of the garment prior to ironing/drying.

Prior to ironing, an operator places the shirt or other item of clothing on the mannequin, taking care to stretch it correctly using any specific tensioning elements.

Afterwards, the sequential emission of steam and then hot air assures, respectively, the ironing and drying of the item of clothing.

These known machines however have some drawbacks.

Much of the produced hot air and steam is lost in the working environment, with the consequent considerable waste of energy.

Furthermore, the repeated emission of hot air and steam in small working environments may cause a considerable increase in temperature and humidity inside the environment.

This can make the operators' working conditions difficult or even unacceptable, requiring the use of appropriate suction hoods to convey the generated steam and hot air outside of the working environment.

Ironing machine, comprising a support element in the form of a mannequin, a steam or hot air supply circuit and emission means associated to the supply circuit and defined on the support element, are known from documents FR 2 716 211 and GB 2 020 317.

SUMMARY OF THE INVENTION

The main aim of the present invention is to provide an upgraded ironing machine, particularly for ironing and drying garments, such as shirts, jackets or the like which offers greater energy savings compared to the currently known machines.

Another object of the invention is to provide an upgraded ironing machine, particularly for ironing and drying garments, such as shirts, jackets or the like which allows for the improvement in the working conditions of the ironing/drying operators.

Another object of the present invention is to provide an upgraded ironing machine, particularly for ironing and drying garments, such as shirts, jackets or the like that allows to overcome the mentioned drawbacks of the background art in the ambit of a simple, rational, easy, effective to use and low cost solution.

The above-described objects are achieved by this upgraded ironing machine, particularly for ironing and drying garments, such as shirts, jackets or the like, comprising a bearing structure, at least one support element supported by said bearing structure and suitable for supporting at least one garment to be ironed, at least one steam or hot air supply circuit, and at least an emission apparatus associated to said supply circuit and suitable for emitting at least one flow of steam or hot air for the ironing and/or drying of said garment, characterised in that it comprises at least a suction device associated to said supply circuit for the suction and reuse during ironing and/or drying of at least a part of the flow of emitted steam or hot air.

BRIEF DESCRIPTION OF THE DRAWINGS

Other characteristics and advantages of the present invention will become more evident from the description of a preferred, but not sole, embodiment of an upgraded ironing machine, particularly for ironing and drying garments, such as shirts, jackets or the like, illustrated purely as an example but not limited to the annexed drawings in which:

FIG. 1 is an axonometric view of the machine according to the invention;

FIG. 2 is an axonometric and partially section view of the machine according to the invention.

DETAILED DESCRIPTION OF THE EMBODIMENTS

With particular reference to such figures, by 1 is globally indicated an upgraded professional ironing machine, of the type usable in the industrial laundry sector and in the field of industrial ironing generally, for ironing and drying garments, such as shirts, work coats, jackets, coats, overcoats, ladies' dresses or the like.

The machine 1 comprises a bearing structure 2, composed of a base which may be positioned resting on the ground and suitable for housing part of the electronics and mechanics of the machine itself.

The base 2 supports a support element 3 which is suitable for supporting a garment to be dried and ironed.

Referring to the particular form of embodiment of the machine 1 illustrated in the figures, the support element 3 extends vertically from the base 2 and is composed of a mannequin, of the traditional type used for shirt drying and ironing machines, which reproduces the torso of a human figure and which is appropriately shaped to be dressed with a shirt C to be dried and ironed.

Other forms of the support element 3 are not however to be ruled out, which may allow, for example, the drying and ironing of garments such as work coats, jackets, coats, overcoats, ladies' dresses or the like.

The machine 1 may also comprise one or more tensioning elements, of a known type and generically indicated in figures with reference 4, which assure the correct stretching of the fabric of the shirt C prior to drying and ironing. In particular, these tensioning elements 4 may comprise mobile arms on which grippers are mounted to grip the sleeves of the shirt C, locking grippers for the rear and front portion of the shirt C or other grippers besides.

The machine 1 comprises a steam or hot air supply circuit used for ironing and drying; this supply circuit is illustrated in a diagram and partly in FIG. 2 and is indicated generally by reference number 5.

The supply circuit 5 comprises a generation apparatus for generating a flow F of steam or hot air, with a ventilation unit, illustrated generally in FIG. 2 with reference number 6, and a boiler of conventional type, which is not illustrated in the aforementioned figures.

In particular, the ventilation unit 6, together with heating means of the electrical resistance type or the like, is used to generate the hot air used during the drying of the shirt C.

The ventilation unit 6 is of the compressor type or the like and, with reference to the particular form of embodiment of the machine 1 illustrated in the figures, is composed of a ventilator equipped with a fan housed inside a suitable guard 7 and moved by a suitable motor 8.

The boiler may be arranged inside the base 2 and is suitable for generating the steam used during the ironing of the shirt C.

Alternatively, the presence on the supply circuit 5 of a suitable supply mouth connected to a ventilation unit and/or a boiler external to and separated from the machine 1 is not to be ruled out.

The machine 1 also comprises an emission apparatus 9 associated to the supply circuit 5 which emit the flow F of steam or hot air used during the ironing and drying of the shirt C, respectively.

In particular, the emission apparatus 9 is composed of a plurality of emission holes for the flow F of steam or hot air, distributed substantially along the whole surface of the mannequin 3, below a coating produced from breathable fabric.

The machine 1 comprises a suction device 10 of at least a part of the flow F of steam or hot air. Advantageously, the suction device 10 is associated to the supply circuit 5 for the reuse, during the ironing and drying of the shirt C, of part of the flow F of steam or hot air emitted from the emission holes 9.

In particular, the suction device 10 comprises a suction mouth 11 arranged near the mannequin 3.

Usefully, the suction mouth 11 is arranged at a rear and substantially median portion of the mannequin 3 and has a substantially truncated cone shape. This shape and arrangement, together with the size of the opening of the suction mouth 11 assure excellent suction, this being understood as the ability to suction the greatest possible volume of steam or hot air emitted from the emission holes 9 on the mannequin 3.

Other shapes and arrangements of the suction mouth 11 or the use of several suction mouths 11 arranged at respective portions of the mannequin 3 are not however to be ruled out.

The suction device 10 also comprises a connection apparatus 12 between the suction mouth 11 and the supply circuit 5, composed of a substantially vertical pipe.

The pipe 12 has a lower end fixed to a recirculation mouth obtained on the guard 7 of the ventilation unit 6 which assures the infeed of the flow F of suctioned steam or hot air. The suction mouth 11 extends substantially horizontally from the upper end of the pipe 12, to the mannequin 3.

Alternatively, the suction device may comprise a dedicated suction unit separated from the ventilation unit 6, composed of a further fan or the like.

Usefully, the machine 1 may envisage the use of a further suction hood 13 of the traditional type, used to convey any steam and hot air not suctioned and reused by the suction device 10 out of the working environment.

Finally, the machine 1 has a management and control panel, illustrated schematically in FIG. 1 and indicated by reference number 14, which assures the interface with an operator in charge of ironing and drying shirts. In particular, the management and control panel 14 is electronically connected to the motor 8 of the suction device 10, the ventilation unit and the boiler of the supply circuit 5, the tensioning elements 4 and, where installed, to the hood 13.

The invention works as follows.

Prior to ironing/drying the operator places a shirt C to be ironed/dried on the mannequin 3, stretching the sleeves and locking the shirt into position using the tensioning elements 4 provided.

Afterwards, using the management and control panel 14, he operates the boiler of the supply circuit 5 and the motor 8 to emit in sequence the steam for ironing and the hot air for drying.

During the ironing and drying of the shirt C the ventilation unit 6 suctions steam or hot air through the suction mouth 11, along the pipe 12, and re-emits it into the supply circuit 5.

It has in practice been seen how the described invention achieves the set objects, and in particular, it is underlined that the presence of the above-described suction device assures the recovery and reuse of at least part of the steam or hot air produced, achieving considerable energy savings compared to the known machines.

Furthermore, the suction of the steam or hot air by the suction device, even if partial, also considerably reduces the humidity and temperature values inside the working environment, thus improving the working conditions of the ironing/drying operators.

The invention thus conceived is susceptible to numerous modifications and variations, all of which falling within the scope of the inventive concept.

Furthermore all the details may be replaced with others that are technically equivalent.

In practice, the materials used, as well as the contingent shapes and dimensions, may be any according to requirements without because of this moving outside the protection scope of the following claims.

The invention claimed is:

1. An upgraded ironing machine, for ironing and drying garments such as shirts or jackets, comprising:

a bearing structure;

at least one support element supported by said bearing structure and of the type of a mannequin suitable for supporting at least one garment to be ironed;

at least one steam or hot air supply circuit;

at least one emission apparatus associated to said supply circuit and suitable for emitting at least one flow of steam or hot air for the ironing and/or drying of said garment, said emission apparatus comprising a plurality of emission holes for said flow of steam or hot air, distributed on at least a portion of the surface of said support element; and at least one suction device associated to said supply circuit for the suction and reuse during ironing and/or drying of at least a part of the flow of emitted steam or hot air emitted by said emission holes, said suction device comprising at least one suction mouth of frustoconical shape arranged near said support element and connection apparatus between said suction mouth and said supply circuit, said suction mouth being located at a substantially median portion of said mannequin and at the rear portion of said mannequin.

2. The machine according to claim 1, wherein said connection apparatus comprises at least one connection pipe between said suction mouth and said supply circuit.

3. The machine according to claim 1, wherein said suction device comprises at least one suction unit placed in between said suction mouth and said emission apparatus.

4. The machine according to claim 1, wherein said suction device comprises at least one compressor and at least one ventilator.

5. The machine according to claim 1, wherein a recirculation mouth is associated with a pipe of the suction device.

6. The machine according to claim 1, further comprising a generation apparatus comprising at least a ventilation unit for generating the flow of steam or hot air.

7. The machine according to claim 6, wherein said ventilation unit comprises at least one compressor and at least one ventilator.

8. The machine according to claim 6, wherein said ventilation unit and said suction unit coincide.

9. The machine according to claim 5, wherein said recirculation mouth is defined by said ventilation unit.

10. The machine according to claim 1, wherein said supply circuit comprises at least one supply mouth associable to an external generation apparatus suitable for generating said flow of steam or hot air.

11. The machine according to claim 1, wherein said bearing structure comprises a base supporting said support element.

12. The machine according to claim 1, wherein said bearing structure comprises a mannequin for supporting garments, and wherein said emission holes are distributed substantially along the whole surface of said mannequin.

13. The machine according to claim 1, further comprising a management and control panel operatively connected between said suction device and said supply circuit.

14. The machine according to claim 1, wherein said supply circuit comprises at least one generation apparatus for generating said flow of steam or hot air, and at least one recirculation mouth associated to said suction device which assures the further infeed of said flow of suctioned steam or hot air.

15. The machine according to claim 14, wherein said generation apparatus comprises a boiler.

* * * * *